United States Patent [19]

Phinney

[11] 4,119,185

[45] Oct. 10, 1978

[54] MARINE PROPULSION CONTROL SYSTEM WITH MANEUVERING BRAKE

[75] Inventor: John M. Phinney, Milwaukee, Wis.

[73] Assignee: The Falk Corporation, Milwaukee, Wis.

[21] Appl. No.: 784,165

[22] Filed: Apr. 4, 1977

[51] Int. Cl.[2] ..... F16D 67/02

[52] U.S. Cl. ..... 192/.094; 192/4 C

[58] Field of Search ..... 192/.094, .098, .049, 192/.072, 4 C; 74/480 B

[56] References Cited

U.S. PATENT DOCUMENTS

| | | | |
|---|---|---|---|
| 3,543,891 | 12/1970 | Mathers | 192/.098 X |
| 3,669,234 | 6/1972 | Mathers | 192/.098 |
| 3,900,090 | 8/1975 | Kobelt | 192/.098 X |

*Primary Examiner*—James F. Coan

*Attorney, Agent, or Firm*—Quarles & Brady

[57] ABSTRACT

There is disclosed an improved control system for air actuated ahead and astern clutches, an engine speed governor, and a propeller shaft brake of a marine propulsion system. The control is actuated by a throttle lever which is moved from a neutral position to select a direction of travel. The degree of movement from neutral of the throttle lever is representative of the desired speed in the selected direction. The improved control engages the brake when the throttle lever is in neutral and when the throttle lever is moved from an ahead to an astern direction at medium or high forward speeds. When such a change in commanded direction occurs, a shift delay valve is first actuated to delay the inflation of the astern clutch. The delay is dependent upon the forward speed previously prevailing. At medium forward speeds the brake is released shortly after the astern clutch begins to inflate. At high forward speeds the brake is released when the pressure within the inflating astern clutch reaches a predetermined level. At low forward speed, the brake will not be engaged. The shift delay valve can be manually overridden to immediately signal for the inflation of the astern clutch.

9 Claims, 5 Drawing Figures

MARINE PROPULSION CONTROL SYSTEM WITH MANEUVERING BRAKE

BACKGROUND OF THE INVENTION

This invention relates to ship propulsion systems, and more particularly to an improved propulsion system control for a brake operable on the propeller shaft during initial transition from moderate or high forward ship speed to astern travel.

A common form of marine propulsion system employs ahead and astern air actuated clutches for connecting the prime mover to a reversing reduction gear unit for the propeller. The air actuated clutches are engaged by inflation and the degree of clutch engagement can be controlled by controlling the amount of inflation. A pneumatic control system is normally provided for controlling the amount of inflation and this control system also typically provides control for an engine speed governor which determines the engine speed. A single throttle lever apparatus can be provided for controlling both the clutch engagement and engine speed by movement of the lever in an ahead or astern direction from neutral. An example of such a control for a ship's propulsion system is found in my earlier U.S. Pat. No. 3,727,737, issued Apr. 17, 1973, for "Pressure Modulating System for Reversing Clutches and Throttle Control."

In the system of my earlier patent, I provided a pneumatic clutch control assembly for a ship's propulsion system that was sequentially operated to regulate the inflation of ahead and astern air inflatable clutches and to also control the prime mover speed. The control assembly was actuated by a single throttle lever located on a pilot house control stand. Movement of the lever in one direction provided forward rotation of a propeller at a speed which increased with handle travel away from neutral. Movement of the handle in the opposite direction provided astern rotation of the propeller with speed increasing as the handle was moved farther from neutral. The center position provided a neutral setting in which the engine was disconnected from the propeller and no power was transmitted, although the engine continued to idle.

The single lever control of both direction and speed was accomplished in the following manner: As the lever was pivoted in either direction from neutral, air was supplied to a selector valve which selected one or the other of the ahead and astern clutches. Thereafter, and up to a first control pressure, air pressure proportional to the position of the lever away from neutral fed through a first valve to the clutch and thereby began inflating the selected clutch. During this time the engine would remain at idle speed. After a first control pressure was reached, the first valve was piloted and it connected a second path for air to the clutch. This second path had provision for an initial programmed rate of feed of air to the clutch through a choke valve so as to softly inflate the clutch. Upon reaching a second higher control pressure, full supply air pressure was connected to the clutch. After the first control pressure was reached, the continued inflation of the clutch was not dependent upon the position of the throttle lever.

When the air pressure within the clutch rose to a predetermined level, the control of my earlier patent piloted a governor valve which, in effect, connected the throttle lever control to the speed governor of the engine so that the pressure supplied to the governor directly corresponded to the position of the throttle lever and the speed could be controlled by movement of the throttle lever. The throttle lever setting determined only the final operating speed and direction and all intermediate steps of clutch engagement and inflation, and engine governor speed were handled automatically by the control system.

With the use of high speed engines for ship propulsion, a command from the typical control to change direction from ahead to astern, if attempted to be accomplished at high speeds, can create severe problems with respect to the engagement of the astern clutches at a time when the propeller shaft is rotating at a high speed in the forward direction. To protect the clutches, a brake is applied to the propeller shaft on a reverse reduction gear when a shift from ahead to astern travel is commanded. The purpose of the brake is to absorb heat and relieve the astern clutches of a portion of a heat load which would otherwise be imposed upon them during high speed maneuvers.

When such propeller shaft brakes have been used, the systems have functioned to apply the brake during a delay period in neutral when neither the ahead nor astern clutch are engaged. The disadvantage to such an approach is that it lengthens the time required to alter the ship direction from ahead to astern, and it creates a period during which the ship is not under full control.

In accordance with my invention, I provide a control for a propeller shaft brake which will be applied during the portion of the cycle in which the astern clutch is being engaged. The control of the brake is by internal pressure in the astern clutch and is limited to operation at high vessel speeds. Further, the control will function to begin the application of the brake before the application of the astern clutch under high forward vessel speeds to further increase the effectiveness of the brake.

SUMMARY OF THE INVENTION

In accordance with my invention, I provide a control system for a marine propulsion system having a prime mover controlled by a throttle speed governor, a drive train for transmitting power from the prime mover to a propeller drive shaft, ahead and astern air inflatable clutches for selectably connecting the prime mover to the drive train, a brake operable on the propeller drive shaft, throttle means for actuation of the propulsion system and including means for producing alternative ahead and astern signals and a speed signal, means for controlling the inflation of the selected clutch, and a selector valve responsive to the ahead and astern signals for connecting the selected clutch to the inflation control means, such control including means accumulating a pressure signal responsive to the speed signal in the ahead direction, brake control means responsive to the accumulated pressure signal and to the astern signal to engage the brake so long as the accumulated pressure signal is above a first preselected level or until the astern clutch has been inflated to a predetermined amount, and shift delay means responsive to the accumulated pressure signal to block the astern signal from acting on the selector valve and the brake control means so long as the accumulated pressure signal is above a second, higher preselected level.

Further in accordance with my invention, I provide such a control system which includes means for applying the brake when the throttle lever is in a neutral position and shortly after the ahead signal is removed and while the astern signal is blocked by such shift delay means.

It is a principal object of the invention to provide a control for a marine propulsion system which applies a brake to the propeller drive shaft during initial engagement of the astern clutch and releases the brake prior to astern rotation of the propeller shaft.

It is another object of the invention to provide a control for a marine propulsion system which includes a brake for the propeller shaft which is locked out during low speed ship operation to prevent engine stalling or sluggish control.

It is another object of the invention to provide a brake for the propeller shaft of a marine propulsion system to absorb the heat load normally carried by the astern clutches upon sudden reversal at high speed from forward to astern travel, and which control applies the shaft brake in a timed relation to the inflation of the astern clutch.

The foregoing and other objects and advantages of the invention will appear in the following detailed description. In the description which follows reference is made to the accompanying drawings which form a part hereof and in which there is disclosed a preferred embodiment of the invention.

DESCRIPTION OF THE PREFERRED EMBODIMENT

Figure 1:
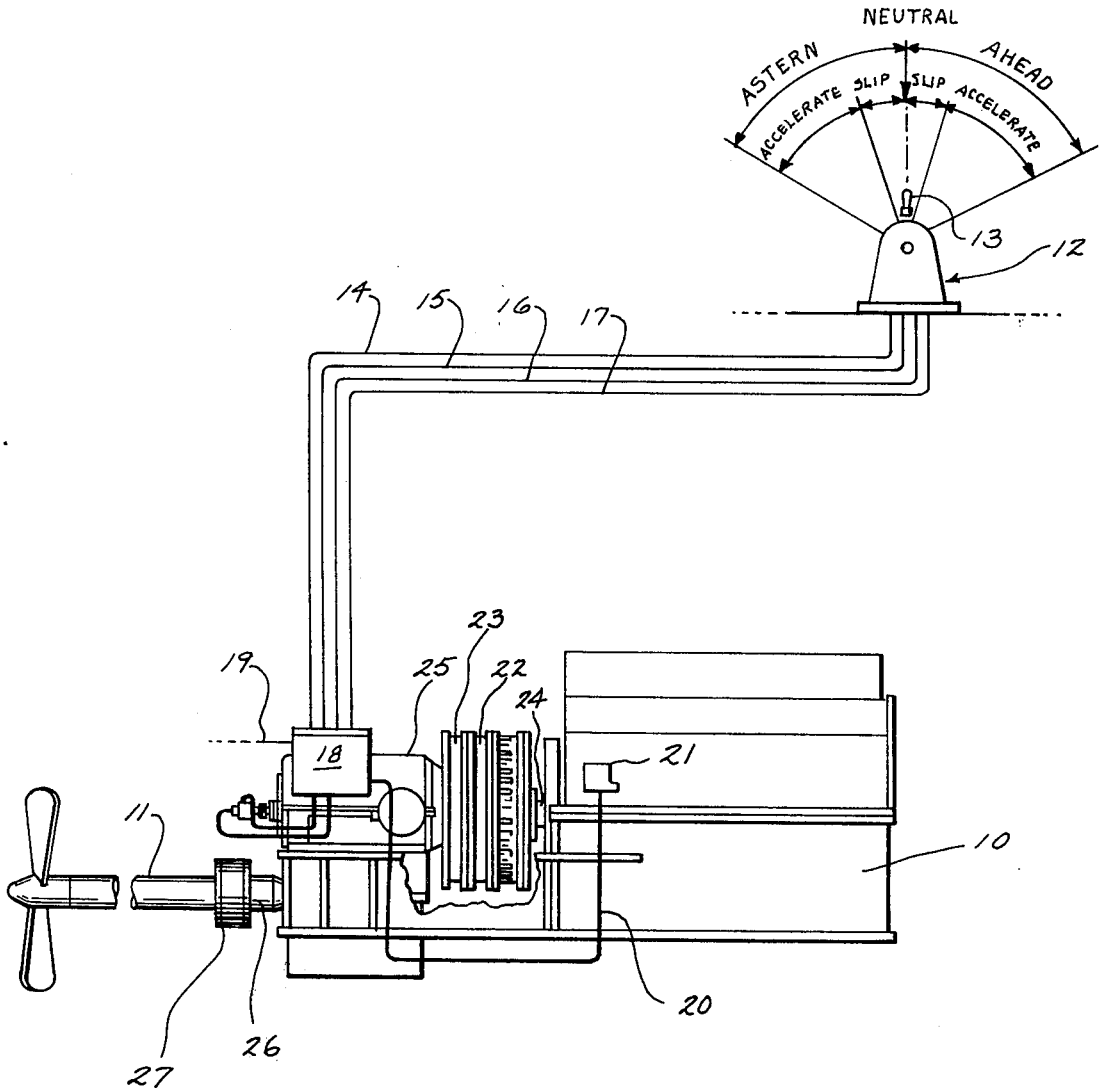
FIG. 1 is a schematic representation of a ship's propulsion system with which the improved control system of the present invention may be employed.

FIG. 1 illustrates a known arrangement of a pneumatically controlled marine propulsion system which controls the speed of the ship's engine 10 and its connection to the propeller shaft 11. The propulsion system includes a pilot house control stand 12 which mounts a throttle lever 13 controlling a throttle valve which connects four air lines 14, 15, 16 and 17 to a control panel assembly 18.

The control panel assembly 18 is connected to the ship's pressurized air source by a main supply line 19. The panel assembly 18 under control of the throttle lever 13 functions to regulate the supply of air through a line 20 to a throttle speed governor 21 for the engine 10 and also functions to control the supply of air to an ahead clutch 22 and an astern clutch 23. The clutches 22 and 23 act to transmit torque from the engine 10, through a drive shaft 24, to the input of a reverse reduction gear train 25 whose output shaft 26 is connected to the propeller shaft 11. The engine 10 is unidirectional and its output is high in speed but low in torque. The reverse reduction gear train 25 functions to reduce the rotational speed and to increase the torque, and also to reverse the direction of drive when required.

In accordance with the present invention, a brake 27 is operative on the output shaft 26 connected to the propeller shaft 11.

The throttle lever 13 is movable forwardly or rearwardly from a neutral position as indicated in FIG. 1 to select the ship's direction of travel. The amount of movement of the throttle lever 13 from neutral regulates the degree of clutch engagement and thereafter the engine speed.

Figure 2:
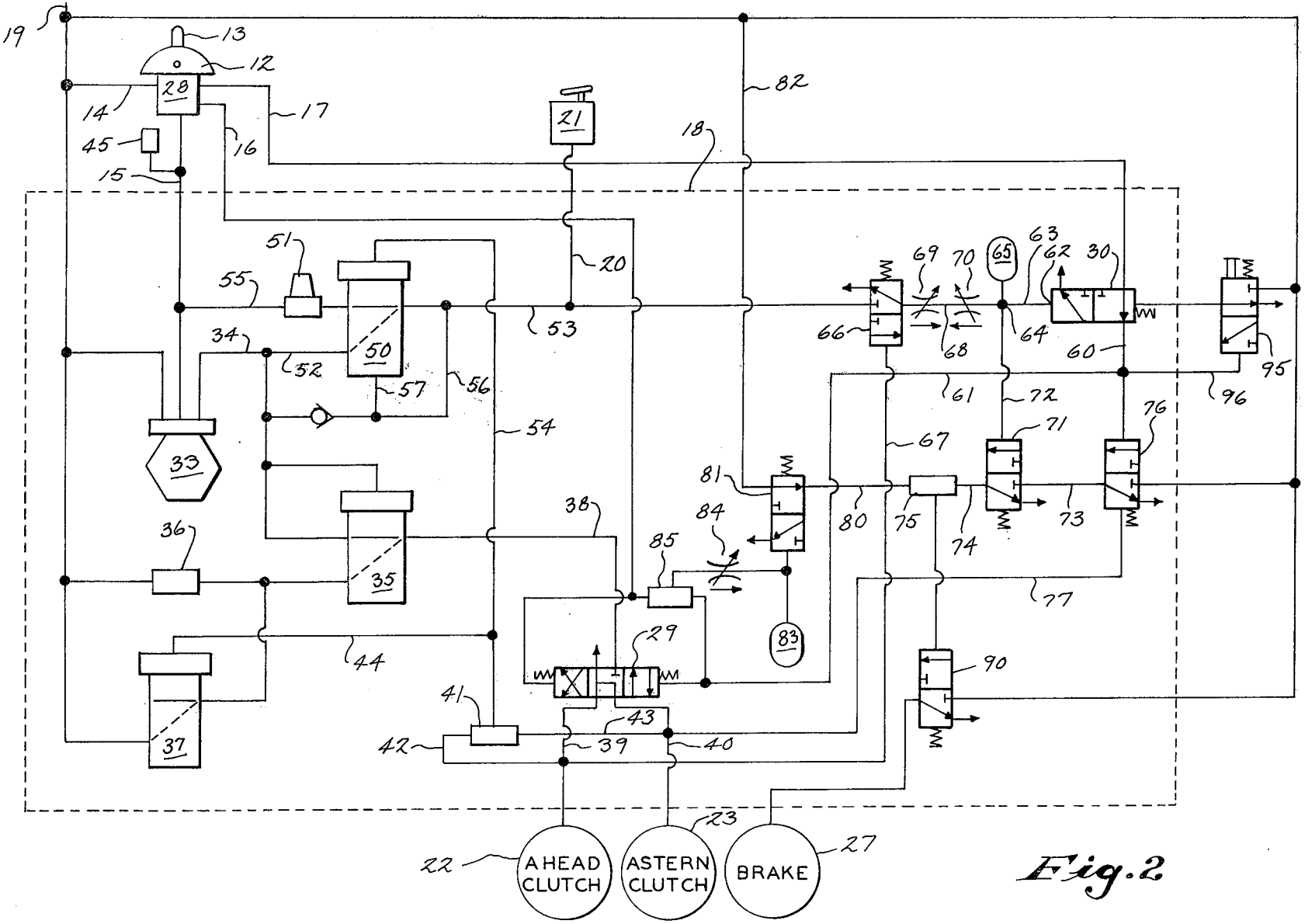
FIG. 2 is a schematic representation of the control system incorporating the present invention and connected to operate the propulsion system of FIG. 1.

Referring to FIG. 2, the throttle lever 13 directly controls a pressure control and directional flow control throttle valve 28. The throttle valve 28 is of known construction and is operative to furnish full supply air pressure from the supply line 14 which leads from the supply air line 19 to one or the other of the ahead and astern piloting air lines 16 and 17, respectively. The throttle valve 28 also supplies graduated pressure to the air line 15 and the graduated pressure is always proportional to the degree of movement of the lever 13 away from neutral.

If the lever 13 is pivoted at least five degrees forward or backward from its neutral position, the throttle valve 28 will connect the supply line 14 to the appropriate piloting air line 16 or 17. If the ahead piloting line 16 is selected, it operates directly to actuate a four-way selector valve 29 for selection of the ahead clutch 22. In previous control systems, selection of the astern piloting line 17 would also operate directly upon the clutch selector valve 29 for selection of the astern clutch 23. As will appear more fully hereafter, in the control of the present invention the air pressure signal in the astern piloting line 17 will actuate the clutch selector valve 29 only if a shift delay valve 30 is open. The movement to select the desired clutch for the desired direction of movement is not sufficient to cause full engagement of the clutches selected, even if the clutch selector valve 29 is immediately actuated. Instead, the initial movement from the neutral position places the propulsion system in a slip condition in which there is insufficient air in the selected clutch to prevent clutch slippage even when the ship's engine 10 is operating at idle throttle speed.

The speed signal line 15, whose air pressure is proportional to lever position, leads to the pilot port of a relay valve 33 whose inlet port is connected to the supply air line 19 and whose outlet port is connected by a line 34 to the inlet port of a master control valve 35. The relay valve 33 will relay or repeat large quantities of supply air from the supply line 19 to the line 34 at a pressure level which is the same as the air pressure in the speed signal line 15. The relay valve 33 and its connection to the supply air line 19 and master control valve 35 constitute a first air branch.

The master control valve 35 has a second inlet port which is connected to a second air branch leading from the air supply line 19. The second branch includes a choke valve 36 and a boost valve 37 connected in parallel across the supply air line 19 and the second inlet port of the master control valve 35.

An outlet port of the master control valve 35 connects to a third air branch which comprises an operating line 38 connected to the inlet port of the clutch selector valve 29. The clutch selector valve 29 has a pair of outlet ports connected by the operating lines 39 and 40 to the ahead clutch 22 and astern clutch 23, respectively.

After the throttle lever 13 has been moved about five degrees forwardly or rearwardly of its neutral position, air under pressure will pass through the master control valve 35 and the clutch selector valve 31 to begin to inflate the selected clutch 22 or 23. During the inflation of one of the clutches, the other clutch will be deflated through its corresponding exhaust port in the clutch selector valve 29. When the control lever 13 is in its neutral position, both clutches 22 and 23 are exhausted to the atmosphere through their respective exhaust ports.

The master control valve 35 is a pneumatic-piloted, pressure sensitive valve that changes the air passages within itself when air at a first control pressure, or higher, is supplied to its pilot port. The pilot port is coupled to the operating line 34 which is also connected to the first inlet port of the master control valve 35. Thus, air at the same pressure level is supplied to both the first inlet port and the pilot port of the master control valve 35 and this pressure is at the same level as that supplied to the relay valve 33 by the line 15 and is representative of the position of the throttle lever 13. So long as the pressure supply through the operating line 34 is less than a first control pressure which is the piloting pressure for the master control valve, that pressure supply will be directed through the master control valve 35 to the operating line 38 and thence to the selected clutch 22 or 23.

When the throttle lever 13 is moved to a position from neutral such that the first control pressure for the master control valve 35 is exceeded, the master control valve 35 will disconnect the first air branch from the clutches and will instead connect the second air branch to the clutch being controlled. At first the choke valve 36 will function to permit air to flow from the supply air line 19 through the master control valve 35 and to the operating line 38 at a programmed rate that is determined by the size of the choke valve 36. As a result, the clutch is not abruptly fully inflated. There is no flow of air through the boost valve 37 at this time because the boost valve 37 is normally closed and will not open until piloted by the air pressure within the clutch being inflated.

The piloting of the boost valve 37 is provided by a clutch inflation shuttle valve 41 which has a pair of inlet ports connected by lines 42 and 43 to the operating lines 39 and 40 for the ahead and astern clutches 22 and 23, respectively. The outlet of the clutch inflation shuttle valve 41 is connected by a piloting line 44 to the pilot port of the boost valve 37. The shuttle valve 41 will connect either one, but not both, of its inlets with its outlet. Thus, air is siphoned from the particular clutch 22 or 23 which is at the highest pressure and is supplied to the pilot port of the boost valve 37. When the air pressure within the inflating clutch reaches a second control pressure at which the boost valve 37 is set to be piloted, that valve will open to connect the supply air line 19 to the second inlet port of the master control valve 35 thereby bypassing the choke valve 36. When this occurs, full supply air pressure is supplied to the operating line 38 and the clutch selector valve 29 so that the selected clutch 22 or 23 will be fully inflated. To deflate, the throttle lever 13 is returned to its neutral position which will cause the clutch selector valve 29 to connect the exhaust ports to the clutches 22 and 23. A bleeder valve 45 is installed to eliminate hysteresis between supply and exhaust portions of the throttle valve 28 under low pressure conditions.

The control panel assembly 18 controls the throttle speed governor 21 by means of a double-piloted throttle governor valve 50 and an engine idel boost regulator valve 51. The throttle governor valve 50 has an inlet connected by a line 52 to the operating line 34 leading from the outlet of the relay valve 33. An outlet port of the throttle governor valve 50 is connected by a speed signal line 53 to the operating line 20 for the throttle speed governor 21. The governor valve 50 has a first pilot port connected by a pilot line 54 to the outlet of the clutch inflation shuttle valve 41.

The idle boost regulator valve 51 has an inlet connected by a line 55 to the line 15 which leads from the throttle valve 28 to the relay valve 33. The outlet of the idle boost regulator valve 51 is connected to the exhaust port of the governor valve 50. Both the governor valve 50 and the regulator valve 51 will be provided with an air pressure signal indicative of the speed at which the engine is to run following engagement of the selected clutch.

The purpose and operation of the governor valve 50 is fully described in my copending application Ser. No. 715,680, filed Aug. 19, 1976, for "Marine Propulsion Control System." Briefly stated, the throttle governor valve 50 controls the speed signal which is imposed upon the throttle speed governor 21 through the line 20 and it will prevent the speed signal from being transmitted at a level which exceeds the clutch capacity under situations where supply air pressure is lost or diminished for any reason such as dirt or contaminations in the line, or a leak.

If the piloting pressure in the line 54 leading from the clutch inflation shuttle valve 41 is sufficient to initially overcome the force of a biasing spring within the governor valve 50, an exhaust valve within the governor valve 50 will first be closed and thereafter the inlet connected to the line 52 will be opened to the outlet leading to the line 53. The throttle governor valve 50 will then be open and an air pressure signal proportional to the position of the throttle lever 13 will pass from the inlet to the outlet and thence to the engine speed governor 21. In this manner engine speed will be controlled by varying the throttle lever position to vary the air pressure signal.

Once the governor valve 50 has been opened, a counter biasing piloting pressure is exerted on the valve which is added to the force of the internal spring which must be overcome by the piloting pressure. This reverse bias pressure is equal to the air pressure which is being transmitted through the governor valve 50 to the throttle speed governor 21 and is directed on a second piloting port through lines 56 and 57 which lead from the outlet line 53 of the governor valve 50. Thus, once the governor valve 50 has opened, the actual air pressure within the selected clutch as transmitted through the clutch inflation shuttle valve 51 must exceed the governor signal pressure plus the force of the governor valve spring. If the supply air pressure is lost or diminished, the maximum governor signal which is allowed to be transmitted to the operating line 20 will be reduced in proportion to the falling clutch pressure.

The operation of the regulator valve 51 is fully disclosed and described in my copending application Ser. No. 759,390, filed Jan. 14, 1977, for "Marine Propulsion Control System with Engine Idle Boost." Briefly stated, the idle boost regulator valve 51 is a commercially available adjustable regulator valve. It will function to pass the speed signal of the line 15 (under control of the throttle lever 13) to the exhaust port of the governor valve 50 and thereafter through the governor valve 50 to the governor 21 so long as the governor valve 50 has not been actuated or piloted to close its exhaust valve. The governor valve 50 is not actuated or piloted until the air pressure within the clutch being engaged reaches a predetermined level. Consequently, the air pressure signal in the line 15 will be imposed upon the engine governor 21 as the selected clutch is being engaged to thereby increase the engine speed over idle. The engine speed which is selected can never, however, exceed the speed which has been selected at the control station by the positioning of the throttle lever 13. Furthermore, the speed can never exceed a preselected level established by the setting of the regulator valve 51 because the output of the regulator valve 51 is not permitted to exceed such pressure setting.

The operation and control described thus far does not differ from the controls previously known. The system in accordance with the present invention will function in the same manner as described above at low forward speeds and at all astern speeds. That is, the shift delay valve 30 will be in a position shown in FIG. 2 in which the astern piloting line 17 is connected to the outlet of the shift delay valve 30 which in turn leads via a line 60 and a connecting line 61 to the astern piloting port of the clutch selector valve 29. The shift delay valve 30 can, however, be actuated to close the valve 30 either automatically or manually.

Specifically, the shift delay valve 30 is a three-way double piloted valve of known construction. One pilot port 62 is connected to a piloting line 63 which leads from a junction 64. Also connected to the junction 64 is a first accumulator 65 whose function is to act as a reservoir for speed pressure signals. The first accumulator 65 is supplied with a speed pressure signal from the line 53 through a normally closed three-way single piloted shift valve 66. In its normal closed position the shift valve 66 has its outlet connected to exhaust as shown in FIG. 2. When piloted by pressure within a line 67 which connects to the operating line 39 for the ahead clutch 22, the shift valve 66 will be actuated to connect the inlet line 53 with an outlet line 68 which leads to the junction 64. The shift valve 66 will be actuated to pass on the speed signal in the line 53 when and only when the ahead clutch has been selected and is inflated to a predetermined pressure level sufficient to overcome the force of a biasing spring in the shift valve 66.

The outlet line 68 from the shift valve 66 is connected to the junction 64 through a pair of inflowing and outflowing adjustable orifices 69 and 70, respectively. The shift valve 66 together with the orifices 69 and 70 and the first accumulator 65 constitute a speed computing circuit. The accumulator 65 will be charged during ahead operation and the accumulation of the pressure within the accumulator 65 will be dependent upon the settings of the orifices 69 and 70 which are adjusted to match the acceleration and deceleration characteristics of a particular vessel. Thus, during ahead operation a pressure signal is accumulated in the first accumulator 65 which is dependent upon the speed setting of the throttle lever 13. When the accumulated speed pressure signal in the accumulator 65 is sufficient to overcome the force of the spring bias in the shift delay valve 30, the shift delay valve 30 will be actuated to connect its output to exhaust. This can only occur during ahead operation because the shift valve 66 is open only during ahead operation and can only occur when the forward vessel speed exceeds an amount represented by the bias spring force of the shift delay valve 30. Thus, the shift delay valve 30 will be actuated to block the astern direction signal in the line 17 when the ship has been traveling in the ahead direction at a speed above some minimum level and when astern travel is thereafter commanded. The shift delay valve 30 will remain in its blocking state until the accumulated pressure in the first accumulator 65 is discharged through the venting shift valve 66 to the level at which it cannot overcome the bias spring force of the shift delay valve 30.

The pressure built up within the first reservoir 65 also acts upon a first brake control valve 71 which has its pilot port connected to the junction 64 by a line 73. The first brake control valve 71 is normally closed so that its output is connected to exhaust and is spring biased to the closed position. When the pressure within the accumulator 65 is sufficient to overcome the spring bias force (which is less than the spring bias force of the shift delay valve 30) the first brake valve 71 connects its outlet to its inlet so that an inlet line 73 will be connected to an outlet line 74 leading to one side of a brake shuttle valve 75. The inlet line 73 is connected to the outlet of a second brake control valve 76 which is normally closed to connect its outlet to exhaust. The second brake valve 76 is a double-piloted, spring biased valve which when activated by the astern pressure signal in the line 60 will be opened to connect supply air to the line 73 leading to the first brake valve 71. The second brake valve 76 will vent the line 73 whenever the internal pressure within the astern clutch 23 rises to the value which, when added to the force of the biasing spring of the second valve 76, is sufficient to overcome the astern pressure signal. The internal pressure in the astern clutch 23 is supplied to the second pilot port of the second brake valve 76 through a line 77 leading from the astern clutch operating line 40.

The brake shuttle valve 75 has its second inlet connected by a line 80 to the outlet of a parking brake valve 81. The inlet of the parking brake valve 81 is connected by a line 82 to the supply line 19. The parking brake 81 is a three-way, single-piloted, spring biased valve which is normally open and which is piloted to close and connect its output to exhaust against the urgings of the biasing spring. The piloting force for the parking brake valve 81 is a pressure signal accumulated in a second reservoir or accumulator 83. the second accumulator 83 is fed through an adjustable orifice 84 from the output of a clutch direction shuttle valve 85. The inputs to the clutch direction shuttle valve 85 are the ahead and astern piloting lines 16 and 61, respectively. When either the ahead or astern clutch selection signals are present across the two inlets of the shuttle valve 85, a pressure signal will be accumulated in the second reservoir 83 which will maintain the parking brake valve 81 closed. The brake valve 81 will open, however, as soon as the pressure signal in the accumulator 83 falls below the value of the spring bias which will indicate that the throttle lever 13 has been moved either into a neutral position or through a neutral position removing momentarily both the ahead and the astern selection signals. There is a short delay in the closing of the parking brake valve 81 as the pressure in the second accumulator is discharged to a point where it can no longer overcome the force of the spring of the valve 81.

The outlet of the brake shuttle valve 75 is connected to the pilot port of a brake supply valve 90. The brake supply valve 90 is normally closed but can be actuated by the piloting pressure from the shuttle valve 75 to connect the air supply line 19 to the brake 27 to inflate and engage the brake with the propeller shaft.

It will be seen from the description thus far that the brake supply valve 90 will be piloted by a signal from the brake shuttle valve 75 whenever either one of two signals are present. One signal will result from the passage of supply pressure through the parking brake valve 81 whenever the clutch selection signals sensed by the clutch direction shuttle valve 85 are removed so that the valve 81 is open. This can occur, for example, when the throttle lever 13 is moved from an ahead position to an astern position if the shift delay valve 30 is closed since the ahead signal in the line 16 will be vented and the astern signal will not be present in the line 61. This will cause the application of the brake 27 to the propeller shaft. The second signal will result if both the first and second brake valves 71 and 76 are open. This will occur when the shift delay has been blocking the astern signal, but is released to thereby pilot the second brake valve 76 open. At the same time, the first brake control valve 71 will have been piloted to open by the pressure in the first accumulator 65 to pass supply air to the brake shuttle valve 75 to actuate the brake supply valve 90 and inflate the brake.

Figure 3:
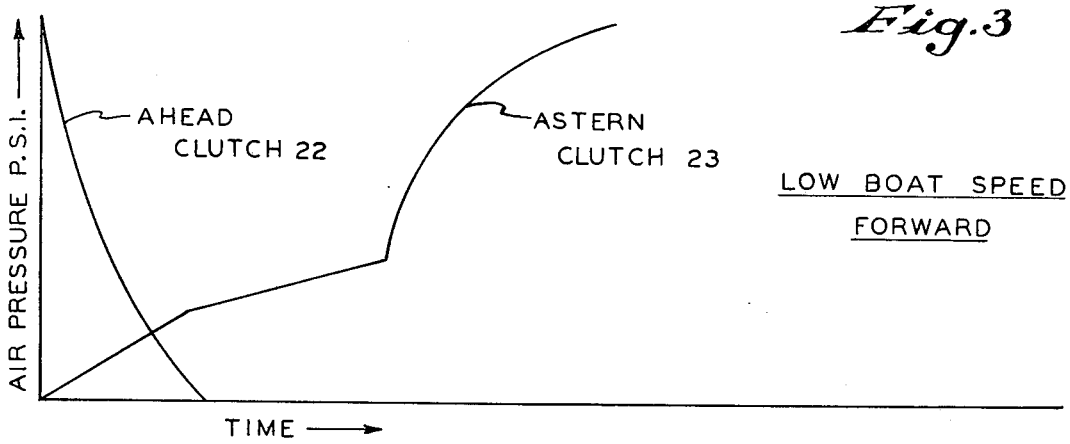
FIGS. 3, 4 and 5 are graphical representations of the operation of the system constructed in accordance with the present invention under three conditions of forward boat speed.

The operation of the system as thus far described may be better appreciated by reference to the graphs of three conditions of forward boat speed and the relationship of the air pressure within the clutches and brake relative to time. FIG. 3 is a representation of the internal clutch pressures of the ahead and astern clutches 22 and 23 in relation to time as a vessel with a low forward speed is commanded to change direction from ahead to astern. Beginning with the movement of the throttle lever 13 through neutral, the ahead clutch pressure will be exhausted and at the same time the internal pressure within the astern clutch will begin to increase under the control of the master control valve 35 as previously described. Because the forward boat speed was low, the speed pressure signal in the line 53 will have been low, and the pressure within the accumulator 65 will be insufficient to actuate the shift delay valve 30 so that the astern clutch selection signal in the piloting line 17 will be immediately imposed upon the clutch selection valve 29 to select the astern clutch for inflation by the clutch inflation control circuit previously described. Furthermore, since there will be no significant length of time in which a clutch selection signal will be unavailable to the clutch direction shuttle valve 85, the pressure within the second accumulator 83 will be sufficient to maintain the parking brake valve 81 closed. Thus, there will be no piloting pressure to actuate the brake supply valve 90 to engage the brake. The brake is not needed at low forward boat speeds because the engine is capable of reversing the propeller shaft immediately without damaging the propulsion system.

Figure 4:
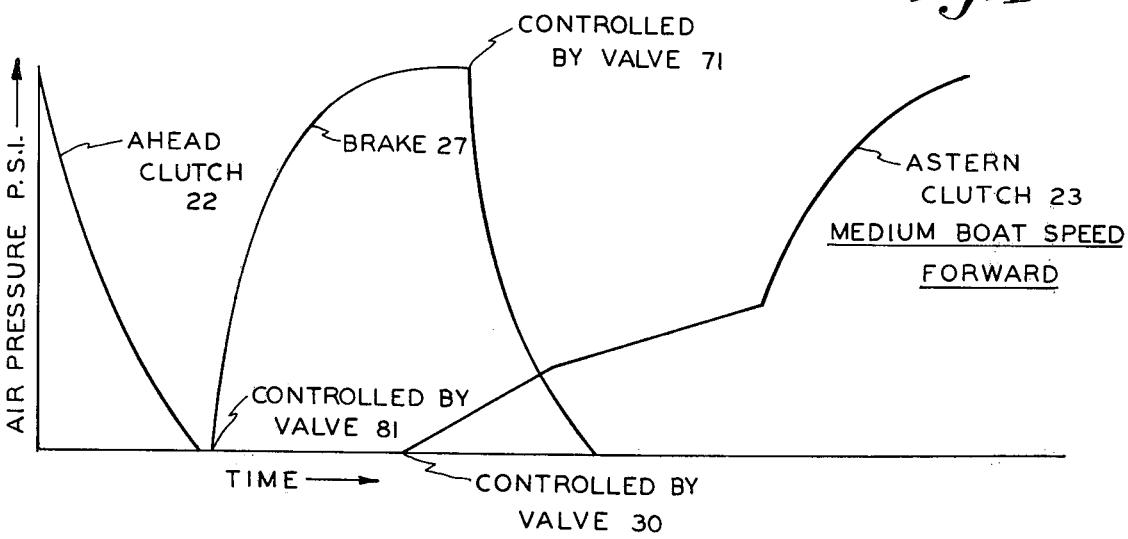

Referring to FIG. 4, at medium forward boat speed, unlike the condition illustrated in FIG. 3, the speed signal will be sufficient to accumulate a pressure in the first accumulator 65 to pilot the shift delay valve 30 thereby delaying the actuation of the asten clutch by blocking the connection from the astern piloting line 17 to the astern pilot port of the clutch selector valve 29. Since neither an astern nor an ahead piloting signal will be presented to the clutch direction shuttle valve 85 under this condition, the accumulated pressure within the reservoir 83 will dissipate until it falls beneath the spring bias force on the valve 81 thereby causing the valve to return to its normally open position connecting the supply line to the brake shuttle valve 75. This will actuate the brake supply valve 90 and engage the brake. At this time, the ahead clutch is vented and the astern clutch has not begun its inflation. The brake 27 will slow down the propeller shaft.

At the same time, since the ahead clutch 22 has been vented, the shift valve 66 pilot force will have been removed and the valve will close so that the speed signal is no longer applied to the line 68 and the accumulator 65 will discharge its accumulated pressure to exhaust through the shift valve 66 until it reaches the level at which it can no longer overcome the preselected level represented by the spring bias of the shift delay valve 30. The shift valve 30 will then return to its normally open position and will pass the astern selection signal to the clutch selector valve 29 to being inflation of the astern clutch 23. The asten direction signal will also pilot the second brake valve 76 to a position in which the valve is open to pass supply air to the first brake valve 71 which will in turn pass supply air to the brake shuttle valve to maintain the brake supply valve 90 actuated and thereby maintain the brake energized even after the parking valve 81 is moved to its closed position. The parking valve 81 will move to a closed position shortly after the passage of the astern which direction signal which will accumulate in the second accumulator 83.

During the portion of the operating cycle the brake will be engaged and the astern clutch will have begun to be inflated. When the pressure within the first accumulator 65 is reduced to a point where it is insufficient to overcome the spring bias force in the first brake valve 71, the valve 71 will return to its normally closed condition thereby venting the line 74 and the actuating line for the brake supply valve 90. The brake will then deflate as the astern clutch continues to inflate. By this time the propeller shaft speed will have been reduced to the point where the engine can reverse the propeller as the astern clutch becomes engaged.

In summary, at medium forward boat speed the delay in the start of the inflation of the astern clutch 22 will be controlled by the shift delay valve 30. The beginning of the inflation of the brake will be controlled by the parking brake valve 81 and the duration of full inflation of the brake will be controlled by the first brake valve 71. In a typical system in which supply air pressure is at a minimum of 125 psi and the clutches are fully inflated at such pressure, the bias spring of the shift delay valve may exert a force of 40 psi which must be overcome to hold such valve closed. The bias spring of the first brake valve 71 would exert a lesser force; for example 35 psi. The bias spring force of the shift valve 66 would be selected to exert a force of about 60 psi to overcome the piloting pressure and the bias spring of the parking brake valve 81 would exert only a moderate force of about 18 psi.

Figure 5:
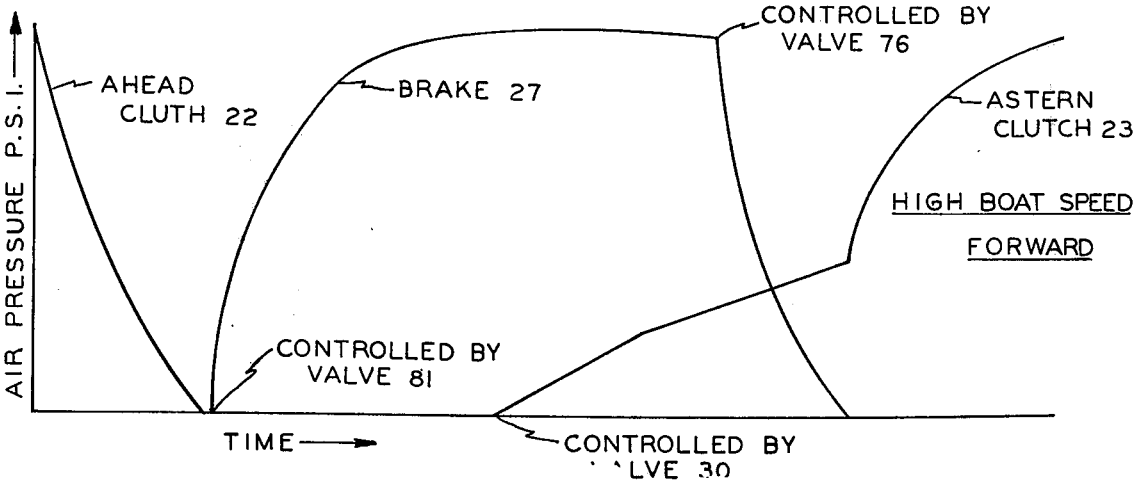

Referring to FIG. 5, the operation at high forward boat speed is similar to that described for medium forward boat speed except that the speed signal accumulated in the first accumulator 65 will be sufficient to overcome the force of the biasing spring of the first brake valve 71 for a longer period of time. Therefore, instead of relying upon the opening of the first brake valve to disengage the brake 27, the disengagement of the brake is made dependent upon the degree of inflation in the astern clutch. Specifically, when the astern clutch has been inflated to an internal pressure sufficient to pilot the second brake valve 76 to return the same to its closed position, the piloting line for the brake supply valves 90 will be connected to exhaust and the brake disengaged. The value of the biasing spring for the second brake valve 76 is established so that the brake will be disengaged just before the propeller reaches zero speed and with the engine near full load. In the typical system referred to above, the spring force would be 80 psi. This eliminates any tendency of the brake to control the clutch operation and reduces the tendency of the engine to stall under difficult maneuvering conditions. Thus, in the condition of high forward boat speed the beginning of inflation of the brake will again be controlled by the parking brake valve 81 but the duration of brake inflation will be controlled by the second brake valve 76.

The brake will not be engaged when the boat is traveling astern and the command is given for ahead operation. This results from the fact that the shift valve 66, which is part of the speed computing circuit, is only actuated to pass the speed signal when there is a pressure within the ahead clutch 22. When operating in the astern direction, there would be no pressure in the ahead clutch so that the speed signal would not be imposed upon the accumulator 65 and the shift delay valve 30 would remain open. Thus, under any conditions of astern boat speed, the brake will not be engaged if the command is made to go forward.

Provision is made to manually override the shift delay valve 30. This is accomplished by a pull to actuate three-way, spring biased valve 95 which has its outlet connected to a second pilot port of the shift delay valve 30 and has its inlet connected to the supply line 19. In its normal position, the manual valve 95 connects the second pilot port of the shift delay valve 30 to exhaust. Upon manual actuation, the pilot port can be connected to supply to return the shift delay valve 30 to its normal open condition against the urgings of the pressure within the accumulator 65 so that the astern selection signal will be passed and will cause immediate commencement of inflation of the astern clutch. A piloting line 96 connects to the outlet 60 of the shift delay valve 30 to provide holdin circuit for the manual valve 95 so that the condition exists until the valve 95 is manually opened.

In addition to initiating engagement of the brake 27 prior to the beginning of inflation of the astern clutch 23, the parking brake valve 81 will function to lock the propeller shaft against rotation whenever the throttle lever 13 is in neutral.

I claim:

1. In a pneumatic control system for a marine propulsion drive which includes a prime mover controlled by a throttle speed governor, a drive train for transmitting power from the prime mover to a propeller drive shaft, astern and ahead air inflatable clutches for selectively connecting the prime mover to said drive train, a brake operable on said propeller drive shaft, throttle means for actuation of the propulsion system and including means for producing alternative ahead and astern direction pressure signals indicative of the desired direction of travel and a speed signal whose magnitude is proportional to desired speed, means responsive to said speed signal for controlling the inflation of a selected clutch, and a clutch selector valve responsive to said direction pressure signals for connecting the selected clutch to said inflation control means, the combination therewith of:

means accumulating a pressure signal responsive to said speed signal while said ahead clutch is inflated for ahead direction of travel, said accumulating means discharging said pressure signal at a controlled rate after said ahead clutch has been deflated, brake control means responsive to said accumulated pressure signal and to said astern direction to engage said brake in response to said astern direction signal and so long as said accumulated pressure signal is above a first preselected level, and shift delay means responsive to said accumulated pressure signal to block said astern direction signal from acting on said selector valve and said brake control means so long as said accumulated pressure is above a second, higher preselected level, said brake control means being further responsive to the internal pressure within said astern clutch to disengage said brake when said astern clutch has been inflated to a predetermined inflation level.

2. A control system in accordance with claim 1 together with throttle governor control means connected to receive said speed signal and adapted to provide a throttle speed pressure signal to said governor which is proportional to said speed signal, and wherein said pressure accumulating means comprises an accumulator connected to receive said throttle speed signal;

a shift valve disposed in said accumulator connection and normally venting said accumulator, said valve being actuated to complete said accumulator connection when the internal pressure in said ahead clutch is above a minimum level; and adjustable inflowing and outflowing orifices in said connection between said accumulator and said shift valve to control the rate of charging and discharging of said accumulator.

3. A control system in accordance with claim 1 wherein said brake control means comprises a pilot actuated brake supply valve normally blocking the connection between said brake and a source of air under pressure;

first and second brake control valves both normally blocking the piloting signal to actuate said brake supply valve;

said first brake control valve being responsive to said accumulated pressure signal to pass said piloting signal when said accumulated pressure signal is above said first level; and said second brake control valve being responsive to said astern direction signal and the internal pressure of said astern clutch to pass said piloting signal in response to said astern directin signal and until said astern clutch pressure rises to said predetermined inflation level.

4. A control system in accordance with claim 3 wherein said first brake control valve is a spring biased, single piloted valve, and wherein said first level is determined by the spring bias.

5. A control system in accordance with claim 3 wherein said second brake control valve is a double piloted, spring biased valve in which the spring bias is additive of the internal pressure of the astern clutch to provide one piloting force in opposition to the opposite piloting force exerted by the astern speed direction signal.

6. A control system in accordance with claim 1 wherein said shift delay comprises a piloted valve which is spring biased to a normally open position and which is piloted to a closed position in response to said accumulated pressure signal, said second preselected level being established by the spring bias force.

7. A control system in accordance with claim 6, together with manual shift delay override means adapted, when actuated, to pilot said shift delay valve to a position in which said valve passes the astern direction signal.

8. A control system in accordance with claim 1, together with second accumulating means for accumulating a pressure signal in response to either the ahead direction signal or the astern direction signal when the same is passed to said selector valve, said second accumulating means discharging such pressure signal at a controlled rate when neither of said direction signals are present, and second brake control means normally completing a connection to engage said brake and being actuated to block said connection so long as the accumulated pressure in said second accumulating means exceeds a minimum predetermined level.

9. A control system in accordance with claim 8 wherein said second brake control means comprises a single piloted, spring biased parking brake valve which is normally open and which is piloted to a closed position by the accumulated pressure of said second accumulating means, said spring bias force of said parking brake valve establishing said minimum predetermined level.

* * * * *

UNITED STATES PATENT OFFICE

CERTIFICATE OF CORRECTION

Patent No. 4,119,185 Dated October 10, 1978

Inventor(s) John M. Phinney

It is certified that error appears in the above-identified patent and that said Letters Patent are hereby corrected as shown below:

| | |
|---|---|
| Column 5, line 64 | "idel" should be -- idle -- |
| Column 6, line 49 | "valve 51" should be -- valve 41 -- |
| Column 8, line 7 | "line 73" should be -- line 72 -- |
| Column 9, line 55 | "asten" should be -- astern -- |
| Column 10, line 9 | "shift valve 30" should be -- shift delay valve 30 -- |
| Column 10, line 12 | "asten" should be -- astern -- |
| Column 10, line 20 | insert -- clutch -- after "astern" |
| Column 10, line 23 | "During the" should be -- During this -- |
| Column 11, line 36 | "outlet 60" should be -- outlet line 60 -- |
| Column 12, line 47 (Claim 3) | "directin" should be -- direction -- |
| Column 12, line 62 (Claim 6) | insert "means" after -- delay -- |

Signed and Sealed this

Sixth Day of February 1979

[SEAL]

Attest:

RUTH C. MASON
Attesting Officer

DONALD W. BANNER
Commissioner of Patents and Trademarks